US005572274A

United States Patent [19]

Lior et al.

[11] Patent Number: 5,572,274

[45] Date of Patent: Nov. 5, 1996

[54] LIQUID DEVELOPER IMAGING SYSTEM AND METHOD UTILIZING AN INTERMEDIATE TRANSFER MEMBER

[75] Inventors: Ishaiau Lior, Nes Ziona, Israel; Benzion Landa, Edmonton, Canada; Amiran Lavon, Bat Yam; Hanna Pinhas, Holon, both of Israel

[73] Assignee: Indigo N.V., Veldhoven, Netherlands

[21] Appl. No.: 115,803

[22] Filed: Sep. 3, 1993

Related U.S. Application Data

[63] Continuation of Ser. No. 446,877, Dec. 6, 1989, abandoned, which is a continuation-in-part of Ser. No. 293,456, Jan. 4, 1989, abandoned.

[51] Int. Cl.[6] ..... G03G 15/16; G03G 15/10

[52] U.S. Cl. ..... 399/296; 430/126; 399/237

[58] Field of Search ..... 355/256, 271, 355/273, 277, 279, 286, 274; 430/126; 219/216, 469, 470

[56] References Cited

U.S. PATENT DOCUMENTS

| | | | |
|---|---|---|---|
| 3,318,212 | 5/1967 | Rubin | 355/281 |
| 3,591,276 | 7/1971 | Byrne | 430/126 |
| 3,671,118 | 6/1972 | Fantuzzo et al. | 355/319 |
| 3,697,171 | 10/1972 | Sullivan | 355/274 X |
| 3,838,919 | 10/1974 | Takahashi | 355/271 X |
| 3,839,032 | 10/1974 | Smith et al. | 355/256 X |
| 3,847,478 | 11/1974 | Young | 355/274 |
| 3,851,964 | 12/1974 | Smith et al. | 355/280 |
| 3,863,603 | 2/1975 | Buckley et al. | 355/251 X |
| 3,893,761 | 7/1975 | Buchan et al. | 355/272 |
| 3,959,574 | 5/1976 | Seanor et al. | 428/425 |
| 4,144,808 | 3/1979 | Iwasa et al. | 355/282 XR |
| 4,411,976 | 10/1983 | Landa et al. | 430/114 |
| 4,430,412 | 2/1984 | Miwa et al. | 430/126 |
| 4,453,820 | 6/1984 | Suzuki | 355/279 |
| 4,515,460 | 5/1985 | Knechtel | 355/274 X |
| 4,518,976 | 5/1985 | Tarumi et al. | 355/279 X |
| 4,585,319 | 4/1986 | Okamoto et al. | 355/200 |
| 4,607,940 | 8/1986 | Quang | 355/268 |
| 4,684,238 | 8/1987 | Till et al. | 355/256 X |
| 4,690,539 | 9/1987 | Radulski et al. | 355/256 X |
| 4,708,460 | 12/1987 | Langdon | 355/271 |
| 4,794,651 | 12/1988 | Landa et al. | 430/110 |
| 4,796,048 | 1/1989 | Bean | 355/277 |
| 4,912,514 | 3/1990 | Mizutani | 355/272 |

FOREIGN PATENT DOCUMENTS

| | | |
|---|---|---|
| 0147341 | 7/1985 | European Pat. Off. . |
| 57-2048 | 1/1982 | Japan . |
| 59-55466 | 3/1984 | Japan . |
| 61-117582 | 6/1986 | Japan . |
| 62-134674 | 6/1987 | Japan . |
| 62-240987 | 10/1987 | Japan . |
| 9004216 | 4/1990 | WIPO . |

OTHER PUBLICATIONS

English Language Abstract of Japanese Application 62–134674.

English Language Abstract of Japanese Application 62–240987.

English Language Abstract of Japanese Application 57–2048.

English Language Abstract of Japanese Application 61–117582.

*Primary Examiner*—Joan H. Pendegrass

*Attorney, Agent, or Firm*—Greenblum & Bernstein, P.L.C.

[57] ABSTRACT

A method for forming an image on a final substrate which includes forming a liquid toner image on a surface using a liquid developer comprising carrier liquid and charged tuner particles, electrostatically transferring the liquid toner image to an intermediate transfer member coated with a release coating and transferring the liquid toner image to a final substrate.

25 Claims, 7 Drawing Sheets

LIQUID DEVELOPER IMAGING SYSTEM AND METHOD UTILIZING AN INTERMEDIATE TRANSFER MEMBER

RELATED APPLICATION

This application is a continuation of application No. 07/446,877, filed Dec. 6, 1989, now abandoned; which is a continuation-in-part of application No. 07/293,456, filed Jan. 4, 1989, now abandoned.

FIELD OF THE INVENTION

The present invention relates to image transfer techniques and apparatus for use in electrophotography.

BACKGROUND OF THE INVENTION

Various prior publications deal with the transfer of single and multiple powder and liquid toner images from a photoreceptor on which they are formed to an intermediate transfer member for subsequent transfer to a final substrate.

U.S. Pat. No. 3,838,919 to Takahashi describes a toner system in which color toner images are sequentially formed on an image forming member, individually transferred to an intermediate transfer member and transferred at one time to a recording member.

U.S. Pat. No. 4,144,808 to Isawa et al. describes a method of printing on a metal plate utilizing powder toner and an intermediate transfer member where the plate is heated before transfer.

U.S. Pat. No. 4,518,976 to Tarumi et al. describes a monochrome powder toner system in which a powder image is developed on a photoreceptor, and transferred electrostatically to an intermediate transfer member. Downstream this transfer, the intermediate transfer member and the image thereon are heated before transfer to a preheated substrate.

U.S. Pat. No. 4,515,460 to Knechtel, describes a powder toner apparatus wherein separate toner images are sequentially developed on a photoreceptor and electrostatically transferred to an intermediate transfer member. After all of the individual images have been transferred to the intermediate transfer member, they are transferred electrostatically to the final substrate. No heating of the images or substrate is disclosed.

U.S. Pat. No. 4,585,319 to Okamoto et al. describes a powder developer type, single color system, utilizing a temperature controlled photoreceptor, a heated intermediate transfer member and a heated transfer fixing roller which is heated to a temperature slightly higher than that of the intermediate transfer member.

U.S. Pat. No. 4,690,539 to Radulski et al. describes a liquid toner multi-color system in which a color image is developed on a photoreceptor and transferred to a belt type intermediate transfer member. The liquid carrier is removed from the toner image on the belt. There is no mention of heating the intermediate transfer member or of a solution to the problem of back transfer.

U.S. Pat. No. 4,708,460 to Langdon describes a single color liquid toner system in which a developed image is transferred from a photoreceptor to an intermediate transfer member, heated on the transfer member and then transferred to a final substrate.

U.S. Pat. No. 3,847,478 to Young describes a duplex printing system, wherein a developed image is transfered from a photoconductor to an intermediate transfer member, a second image is developed on the photoconductor and both images are transfered electrostatically to opposite sides of a piece of paper passed between the intermediate transfer member and the photoreceptor.

None of the above prior art references deal with transferring a heated liquid toner image to an intermediate transfer member or with problems of back transfer from the intermediate transfer member to the photoreceptor in liquid toner multicolor systems.

SUMMARY OF THE INVENTION

The present invention seeks to provide improved apparatus for image transfer.

It is an object of the present invention to provide a method and apparatus for the improved transfer of an image from an image bearing surface to an intermediate transfer member.

It is a further object of the present invention to provide a method and apparatus for the improved transfer of an image from an image bearing surface to an intermediate transfer member and subsequent transfer to a final substrate.

It is a further object of the present invention to provide a method and apparatus for the sequential transfer of a plurality of superimposed images to an intermediate transfer layer without back transfer.

There is thus provided in accordance with a preferred embodiment of the invention imaging apparatus for printing an image from a latent image formed on a latent image bearing surface, including: developing apparatus for developing the latent image with a liquid developer, including carrier liquid and charged pigmented particles, to form a developed image; an intermediate transfer member for receiving the developed image from the latent image bearing surface for subsequent transfer to a final substrate and heating apparatus for heating the developed image during its transfer from the latent image bearing surface to the intermediate transfer member.

In accordance with a preferred embodiment of the invention the imaging apparatus also includes apparatus for further heating of the image during subsequent transfer to the final substrate. Alternatively or additionally the image may be heated prior to its subsequent transfer to the final substrate.

In accordance with a preferred embodiment of the invention a method is provided for forming an image on a final substrate from a latent image on an image forming surface including the steps of:

developing the latent image using a liquid developer including carrier liquid and charged particles to form a liquid toner image;

transferring the liquid toner image to an intermediate transfer member, the liquid toner image being at a higher temperature during the transfer step than during the development step.

In a preferred embodiment of the invention the method also includes the step of:

further transferring the liquid toner image from the intermediate transfer member to a final substrate, the liquid toner image being at a higher temperature during the further transferring step than during the transferring step.

In accordance with a preferred embodiment of the invention a method is provided of transferring a first liquid toner image from a first surface having a first temperature to a second surface having a second liquid toner image thereon, including the steps of:

heating the second surface to a second temperature at transfer which is higher than the first temperature; and transferring the first and second images to a final substrate.

In a preferred embodiment of the invention the second temperature is lower than a temperature at which the second liquid toner image back transfers to the first surface from the second surface.

In a preferred embodiment of the invention the transfer to the intermediate transfer member is by electrophoresis.

Imaging apparatus is also provided, in a preferred embodiment of the invention, for printing multicolor images from latent images formed on a latent image bearing surface including:

apparatus for developing a first latent image with a liquid developer including carrier liquid and charged pigmented particles of a first color;

apparatus for developing a second latent image with a liquid developer including carrier liquid and charged pigmented particles of a second color;

an intermediate transfer member for receiving developed images from the latent image bearing surface;

first transfer apparatus for sequentially transferring the first and second color images from the latent image bearing surface to the intermediate transfer member in mutual alignment;

first heating apparatus for heating the developed images before completion of their respective transfers from the latent image bearing surface to the intermediate transfer member; and second transfer apparatus for transferring the aligned images to a final substrate.

In a preferred embodiment of the invention the second transfer apparatus includes a second intermediate transfer means adapted to receive images from the first intermediate transfer member prior to transfer of the images to the final substrate.

Additionally or alternatively the apparatus includes, in a preferred embodiment of the invention, a second heating apparatus for further heating of the developed first transferred image, such that it is at a higher temperature during transfer to the final substrate than during transfer to the intermediate transfer member.

In a preferred embodiment of the invention the apparatus also includes an additional heating apparatus for further heating of the developed first transferred image during transfer to the final substrate.

A method is also provided for forming an image on a final substrate from at least one latent image formed on at least one image forming surface comprising the steps of:

developing a first latent image using a liquid developer including carrier liquid and charged particles to form a first liquid toner image; and transferring the first liquid toner image to an intermediate transfer member, the first liquid toner image being at a higher temperature during the transfer than during the development.

In a preferred embodiment of the invention the method also includes the steps of:

developing a second latent image using a liquid developer including carrier liquid and charged particles to form a second liquid toner image; and transferring the second liquid toner image to the intermediate transfer member in alignment with the first liquid toner image, the second liquid toner image being at a higher temperature during its transfer than during its development.

In a preferred embodiment of the invention the method also includes the step of:

transferring the multiple images to a final substrate, the multiple images being at a higher temperature during the multiple image transfer step than during the first and second liquid toner image transfer steps.

In a preferred embodiment of the invention there is provided a method for simultaneously printing images from latent images formed on a latent image bearing surface onto both sides of a substrate including the steps of:

(a) developing a latent image with a liquid developer comprising carrier liquid and charged pigmented particles to form a first developed image;

(b) transferring the first developed image from the latent image bearing surface to a first intermediate transfer member;

(c) transferring the developed image from the first intermediate transfer member to a second intermediate transfer member;

(d) developing a latent image with a liquid developer comprising carrier liquid and charged pigmented particles to form a second developed image;

(e) transferring the second developed image from the latent image bearing surface to the first intermediate transfer member; and (f) simultaneously transferring the first and second developed images from the second and first intermediate transfer members to first and second sides of a final substrate.

In a preferred embodiment of the invention the method includes the following additional steps between steps (b) and (c):

(b') developing a latent image with a liquid developer comprising carrier liquid and charged pigmented particles to form an additional developed image; and (b") transferring the additional developed image from the latent image bearing surface to the first intermediate transfer member in alignment with the first developed image, and wherein step (c) also includes transferring the additional developed image together with the first developed image.

The method also includes, in a preferred embodiment of the invention, the further step of:

heating the developed images before completion of their respective transfers from the latent image bearing surface to the first intermediate transfer member.

The method includes in a preferred embodiment of the invention, the further step of:

further heating the developed images such that each of the developed images is at a higher temperature at its respective transfer to the final substrate than at its transfer from the latent image bearing surface to the first intermediate transfer member.

In a preferred embodiment of the invention the simultaneous transfer is aided by heat and pressure.

In accordance with a preferred embodiment of the invention there is provided imaging apparatus for printing an image from a latent image formed on a latent image bearing surface including:

apparatus for developing the latent image with a liquid developer, including carrier liquid and charged pigmented particles, to form a developed image;

a heated intermediate transfer member for receiving the developed image from the latent image bearing surface for subsequent transfer to a final substrate; and apparatus for cooling a portion of the intermediate transfer member prior to transfer of a portion of the developed image to the cooled portion the intermediate transfer member.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
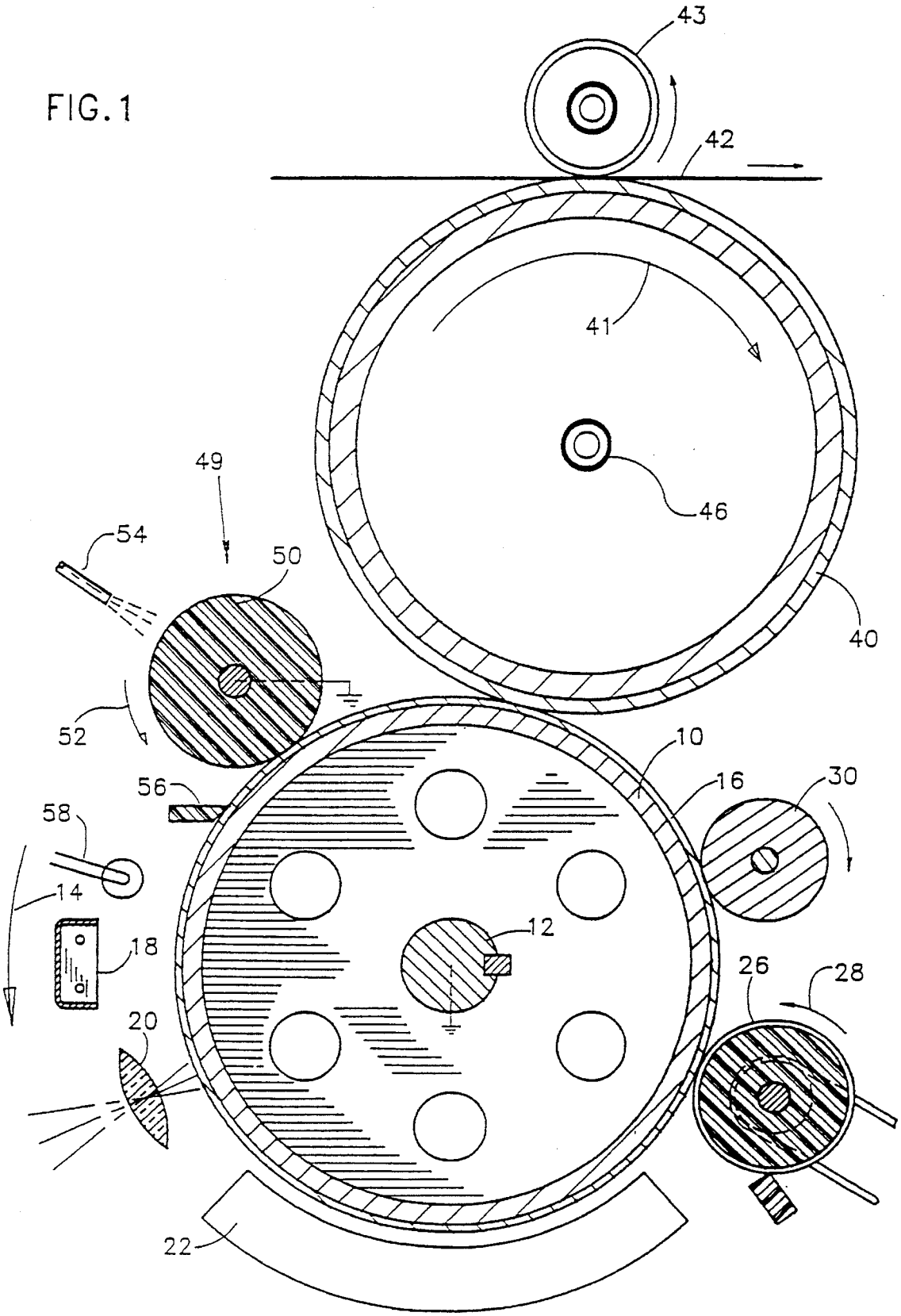
FIG. 1 is a simplified sectional illustration of electrophotographic apparatus constructed and operative in accordance with a preferred embodiment of the present invention.

Reference is now made to FIG. 1 which illustrates electrophotographic imaging apparatus constructed and operative in accordance with a preferred embodiment of the present invention. This and other embodiments of the invention are described in the context of liquid developer systems with negatively charged toner particles and positively charged photoreceptors. Such systems operate in a "write-white" mode, for which areas which are not to be toned are exposed to light. The invention may be useful for other combinations of toner charge, photoreceptor charge as well as for other writing systems, such as "write-black" systems.

The apparatus of the invention is described using a liquid developer system. In accordance with a preferred embodiment of the invention the liquid developer of Example 1 of U.S. Pat. No. 4,794,651 can be used, but other suitable developers may be used in the practice of the invention. Especially useful are liquid developers comprising toner particles which solvate the carrier liquid of the developer at elevated temperatures, above room temperature.

As in conventional electrophotographic systems, the apparatus of FIG. 1 comprises a drum 10 arranged for rotation about an axle 12 in a direction generally indicated by arrow 14. Drum 10 is formed with a cylindrical photoreceptor surface 16.

A corona discharge device 18 is operative to generally uniformly charge photoreceptor surface 16 with a positive charge. Continued rotation of drum 10 brings charged photoreceptor surface 16 into image receiving relationship with an exposure unit including a lens 20. Lens 20, focuses a desired image, which may be laser generated, onto charged photoreceptor surface 16, selectively discharging the photoreceptor surface, thus producing an electrostatic latent image thereon.

Continued rotation of drum 10 brings charged photoreceptor surface 16 bearing the electrostatic latent image into operative association with a development unit 22, operative to apply a liquid developer to develop the electrostatic latent image. For multicolor copying or printing, the development unit 22 can, for example, comprise a plurality of developers, one for each color, which are selectively engaged with the photoreceptor, as described, for example, in in U.S. Pat. No. 4,690,539, which is incorporated herein by reference, or a single development station where the liquid toner is changed between colors, or any other suitable development system. In general this development process takes place at a relatively low temperature, namely approximately the temperature of the environment of the system.

In accordance with a preferred embodiment of the invention, following application of toner thereto, photoreceptor surface 16 passes a typically positively charged rotating roller 26, preferably rotating in a direction indicated by an arrow 28. Roller 26 functions as a metering roller and reduces the thickness of liquid on photoreceptor surface 16. Typically the spatial separation of roller 26 from photoreceptor surface 16 is about 50 microns.

Preferably the voltage on roller 26 is intermediate the voltages of the latent image areas and of the background areas on the photoreceptor surface. Typical voltages are: roller 26: +200V, background area: +50V and latent image areas: up to about +1000V.

Liquid which passes roller 26 should be relatively free of pigmented particles except in the region of the latent image.

Downstream of roller 26 there is preferably provided a rigidizing roller 30. Rigidizing roller 30 is preferably formed of a resilient polymeric material, such as conductive resilient polymeric material as described in either or both of U.S. Pat. Nos. 3,959,574 and 3,863,603. Roller 30 is preferably resiliently urged against photoconductive surface 16.

In a preferred embodiment of the invention, a biased squeegee roller is used as roller 30. Roller 30 is negatively charged to a potential of at least several hundred and up to 2000 volts with the same sign as the charge on the pigmented toner particles, so that it repels similarly charged pigmented particles and causes them to more closely approach the image areas of the photoreceptor surface 16, thus compressing and rigidizing the image.

Downstream of rigidizing roller 30 there is provided an intermediate transfer member 40, which rotates in a direction opposite to that of photoreceptor surface 16, as shown by arrow 41, providing zero relative motion between their respective surfaces at the point of propinquity. Intermediate transfer member 40 is operative for receiving the toner image photoreceptor surface 16 and for transferring the toner image to a receiving substrate 42, such as paper. Disposed internally of intermediate transfer member 40 there may be provided a heater 46, to heat intermediate transfer member 40.

Various types of intermediate transfer members are known and are described, for example in U.S. Pat. No. 4,684,238 and in assignee's copending U.S. patent application entitled METHOD AND APPARATUS FOR IMAGING USING AN INTERMEDIATE TRANSFER MEMBER filed Jan. 4, 1989, and bearing Ser. No. 293,456, the disclosures of both of which are incorporated herein by reference.

Following the transfer of the toner image to intermediate transfer member 40, photoreceptor surface 16 engages a cleaning station 49. This station may be any conventional cleaning station, comprising a cleaning roller 50 which may comprise a suitable resilient material such as foam polyethylene or neoprene. Cleaning roller 50 may be wetted by clean lubricating cleaning liquid, which preferably comprises liquid developer from which all or nearly all of the toner particles have been removed. Cleaning roller 50 is driven so that its surface moves opposite to surface 16 at their nip, to provide scrubbing action for removal of residual particles and carrier liquid from photoreceptor surface 16. A scraper 56 completes the removal of any residual toner which may not have been removed by cleaning station 49.

A lamp 58 completes the cycle by removing any residual charge, characteristic of the previous image, from semiconductor surface 16.

Transfer of the image to intermediate transfer member 40 is preferably aided by providing electrification of intermediate transfer member 40 to a voltage opposite that of the charged particles, thereby causing transfer by electrophoresis. It has been found by the inventors, that, at least for the preferred developer, raising the temperature of the developed toner image to a temperature higher than the development temperature aids this first transfer, even when the transfer is by electrophoresis.

Subsequent final transfer of the image from intermediate transfer member 40 to substrate 42 is preferably aided by heat and pressure. A higher temperature than that used for first transfer is preferably utilized for this subsequent final transfer, in accordance with the present invention.

In the prior art a liquid toner image was first transferred to an intermediate transfer member. The toner image was heated during the interval between first and second transfer so as to aid in final transfer.

In the present invention the preferred first transfer step, i.e., the transfer of the liquid toner image to the intermediate transfer member includes the heating of the image either before or during first transfer. The preferred final transfer step, i.e., the transfer of the liquid toner image to the final substrate, includes the further heating of the image before and/or during second transfer. This further heating can be achieved by heating the image on intermediate transfer member 40, for example by heat transfer from intermediate transfer member 40 during the interval between first and final transfer and/or by external heating of the image. Alternatively or additionally the further heating can be achieved by conduction heating of the image from the final substrate during final transfer.

These preferred first and second transfer steps improve the quality of the image on the final substrate both for single color and for multi-color images.

For multicolor systems it is useful to sequentially transfer the separate colors to intermediate transfer member 40 in alignment with and generally superimposed and in registration with each other and then to transfer them together to paper or other substrate 42. It has then been found that for this configuration, there is a tendency for the heated images previously transferred to the intermediate transfer member at a lower temperature, to transfer back, in whole or in part, to photoreceptor surface 16, when the previously transferred image returns to the point of first transfer.

The embodiments of the invention described herein provide improved first and final transfer and for multicolor systems can solve the back transfer problem.

In general, some of the embodiments of the invention are characterized in that photoreceptor 16 is at a first, relatively low temperature; intermediate transfer member 40 is at a second, somewhat higher temperature, to provide for improved first transfer; and final substrate 42 is at a third, even higher temperature to provide for good transfer from intermediate transfer member 40 to substrate 42.

Alternatively or additionally, some of the embodiments can be characterized in that, when a toner image is transferred from photoreceptor surface 16 to intermediate transfer member 40, and then to final substrate 42, the toner image is hotter during transfer to the intermediate transfer member than it was on the photoreceptor surface and the image is hotter when it is transferred to the final substrate, than during the earlier transfer.

Alternatively or additionally, some of the embodiments can be characterized in that, when multiple toner images are transferred sequentially from photoreceptor surface 16 to intermediate transfer member 40, and then to final substrate 42 as a group, the composite, multicolor toner image is hotter when it is transferred to the final substrate than during any contact of earlier transferred images with the photoreceptor.

One embodiment of the invention can be characterized in that the image is transferred from a photoreceptor surface, at a first relatively low temperature to a first intermediate transfer member at a second intermediate temperature. The image is then transferred to a second intermediate transfer member. Final transfer takes place from the second intermediate transfer member to the final substrate at a third, higher temperature. Preferably, the image temperature during first transfer is higher than that of that portion of the photoreceptor surface not in contact with the intermediate transfer member.

Returning now to FIG. 1, intermediate transfer member 40 is heated to a temperature sufficient to enhance the electrophoretic transfer of toner particles from photoreceptor surface 16 to intermediate transfer member 40. The image is heated during transfer to intermediate transfer member 40, and the heating continues while the image is on intermediate transfer member 40 until the image is at the temperature of intermediate transfer member 40. Rotation of intermediate transfer member 40 brings the heated intermediate transfer member 40 into image transfer relationship with a final substrate 42, which is pressed against the intermediate transfer member by a heated backing roller 43. Heated backing roller 43 heats the paper and thereby heats the image in contact therewith by conduction from the paper, to a sufficient degree to ensure that complete or nearly complete final transfer of the image to the substrate, by heat and pressure, takes place.

While the invention has been described in a monochromatic version, where it gives improved transfer from the photoreceptor to the intermediate transfer member and from the intermediate transfer member to the final substrate, the invention is particularly useful in a multicolor system, wherein images of different colors are sequentially formed on photoreceptor surface 16, and transferred one by one in mutual alignment to image transfer member 40 prior to a single transfer of all of the images, which form a multicolor image, to final substrate 42.

Final substrate 42 is brought into transfer engagement with intermediate transfer member 40 only when all of the colors have been transferred to intermediate transfer member 40, for final transfer of the multicolor image to substrate 42.

As noted above, it is appreciated that during first transfer of subsequent images from photoreceptor surface 16 to image transfer member 40, earlier transferred images return to the region of first transfer. Any back transfer of previously transferred images to photoreceptor surface 16 will result in undesirable artifacts in the final printed image.

Generally if the intermediate transfer member is heated to a temperature which is useful for good final transfer, then there is a tendency for the image to back transfer to the photoreceptor.

The arrangement of FIG. 1, with proper choice of temperatures for intermediate transfer member 40 at first transfer, and for final substrate 42 and the image at second transfer in accordance with the the present invention, substantially eliminates the problem of back transfer to photoreceptor surface 16, by keeping the image temperature, when the image on the intermediate transfer member returns to the photoreceptor, low enough so that it is not tacky enough to stick to the photoreceptor.

Figure 2:
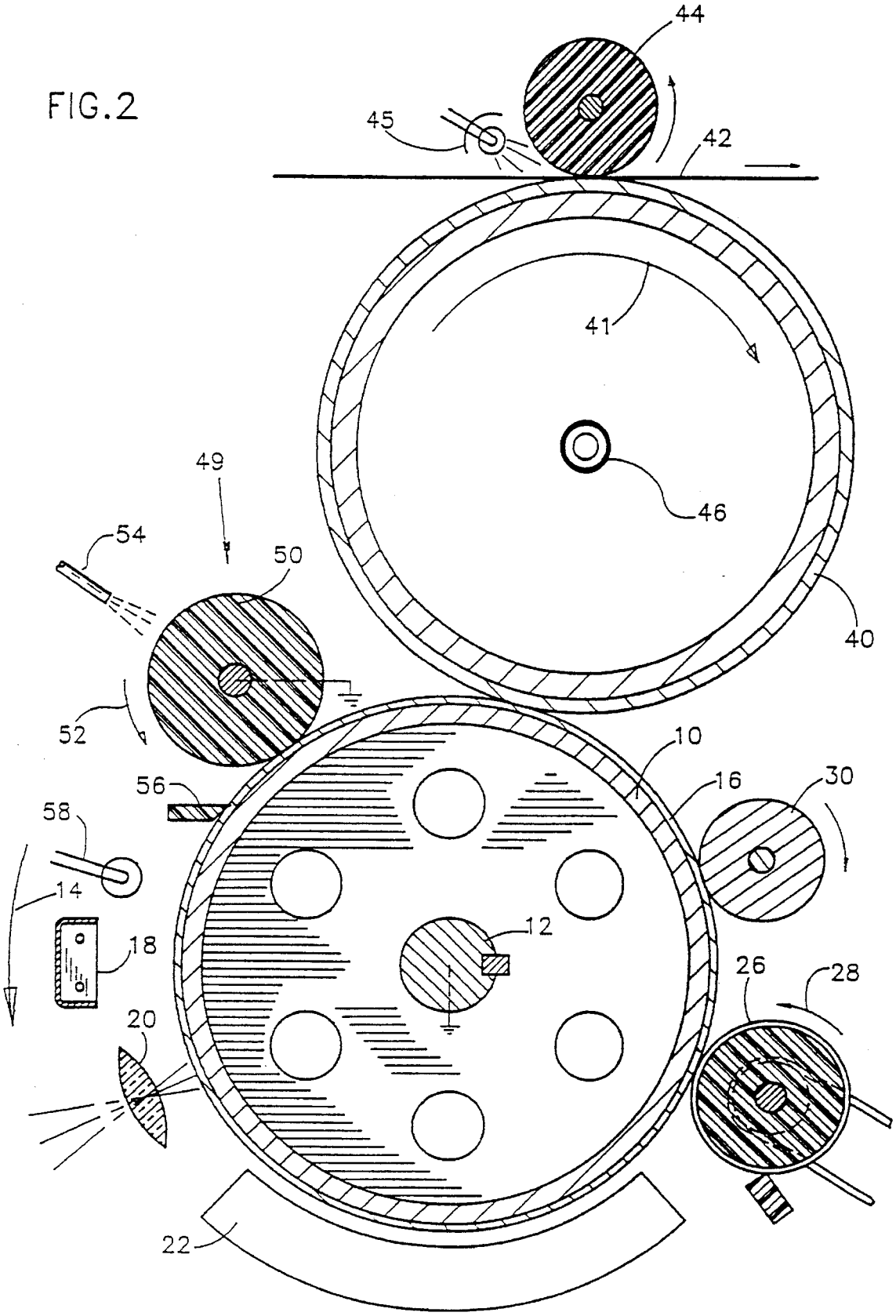
FIG. 2 is a simplified sectional illustration of electrophotographic apparatus constructed and operative in accordance with another preferred embodiment of the present invention.

FIG. 2 shows a second embodiment of the invention in which all of the parts and operation are generally the same as those of the apparatus of FIG. 1, except that heated backing roller 43 is replaced by an unheated backing roller 44, and final substrate 42 is preheated by a heating lamp 45. A combination of the embodiments of FIGS. 1 and 2 is also useful, whereby paper 42 is pre-heated by lamp 45, and heated roller 43 is used.

Figure 3:
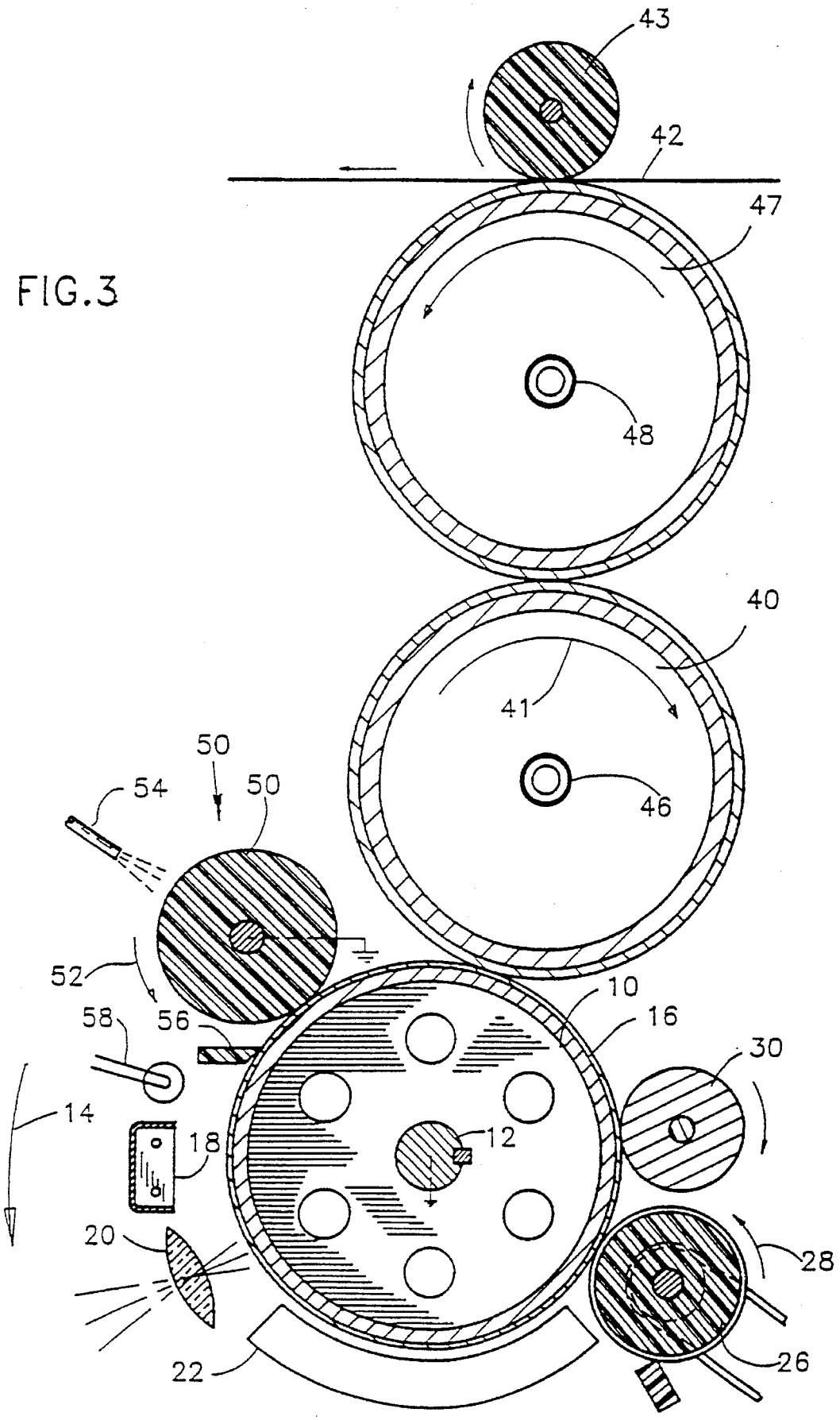
FIG. 3 is a simplified sectional illustration of electrophotographic apparatus constructed and operative in accordance with yet another preferred embodiment of the present invention.

A third embodiment of the apparatus of the invention is shown in FIG. 3. In this case intermediate transfer member 40 is heated to a first, moderate, temperature which is high enough to enhance first transfer, but not so high as to cause substantial back transfer of previously transferred images from intermediate transfer member 40 to photoreceptor surface 16. The images are transferred to a second intermediate transfer member 47 which is heated by an internal heater 48 to a higher temperature, sufficient to assure good final transfer to final substrate 42.

Transfer to second intermediate transfer member 41 can occur sequentially for each of the images, or preferably the images are collected on first intermediate transfer member 40 and then the multicolor image is transferred as a whole to second intermediate transfer member 47 for final transfer to the final substrate 42.

Figure 4:
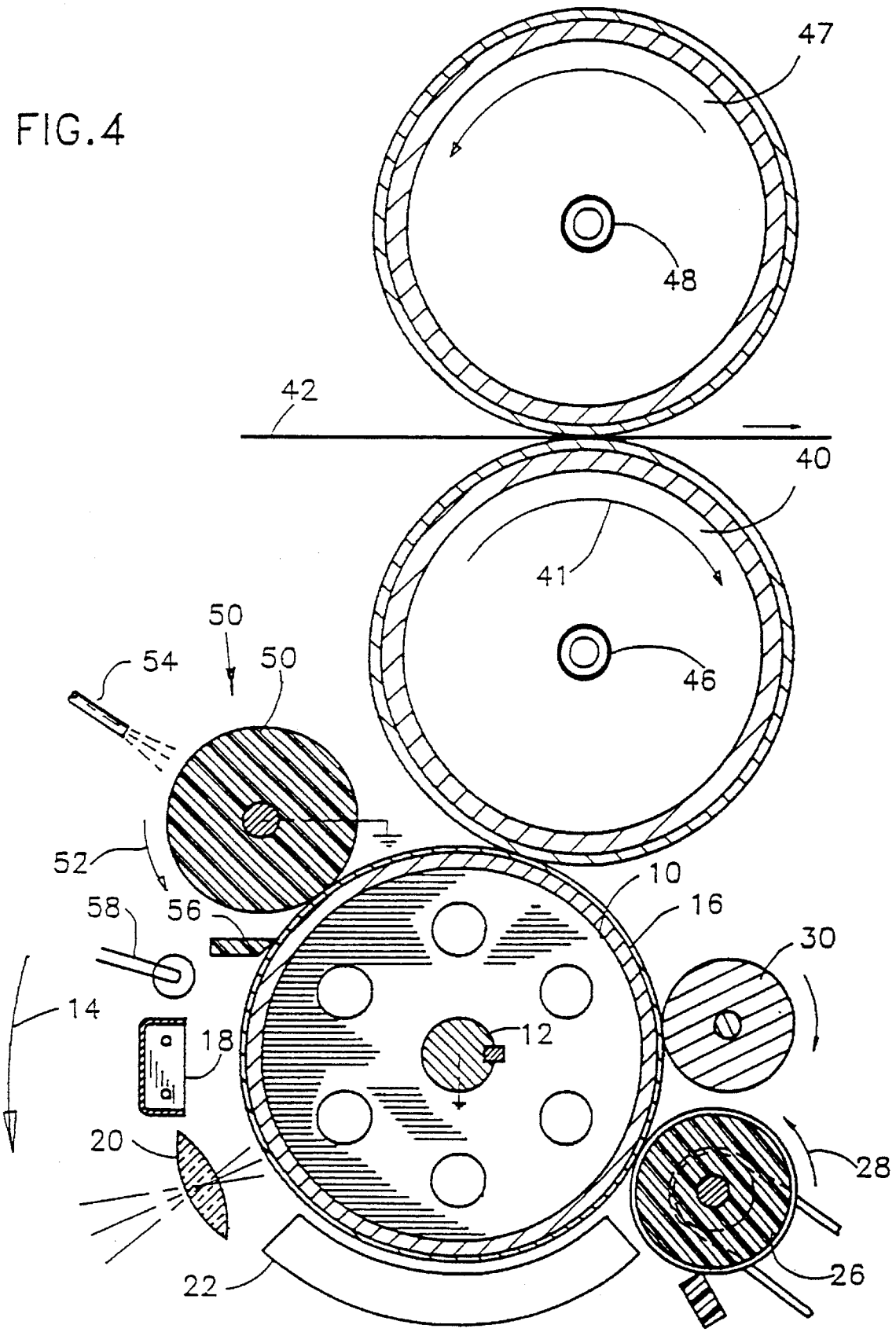
FIG. 4 is a simplified sectional illustration of a electrophotographic apparatus constructed and operative in accordance with yet another preferred embodiment of the present invention.

A duplex embodiment of the invention, for printing two sides of a substrate at the same time is shown in FIG. 4. The separate color images which make up the multi-colored image to be printed on a first side of substrate 42 are first transferred sequentially to intermediate transfer member 40 and then are transferred, preferably as a group, to second intermediate transfer member 47. Second image transfer member 47 is preferably heated to a higher temperature than intermediate transfer member 40. The images to be printed on the other side of the page are subsequently transferred sequentially to intermediate transfer member 40, which is meanwhile kept out of transfer engagement with second intermediate transfer member 47.

Final substrate 42 is then passed between intermediate transfer member 40 and second intermediate transfer member 47, while pressing the two intermediate transfer members together to effect transfer of the images to both sides of the paper by heat and pressure. It is understood that preferably second intermediate transfer member 47 heats substrate 42 and the image to a suitable temperature to assure good transfer of the image on intermediate transfer member 40 to substrate 42. Alternatively or additionally, the paper may be heated before transfer as described above in connection with FIG. 2.

In some preferred embodiments of the invention intermediate transfer member 40 acts to heat the image to a first temperature during first transfer from photoreceptor 16 to intermediate transfer member 40, and to heat the image to a second higher temperature before second and final transfer from intermediate transfer member 40 to final substrate 42.

Figure 5:
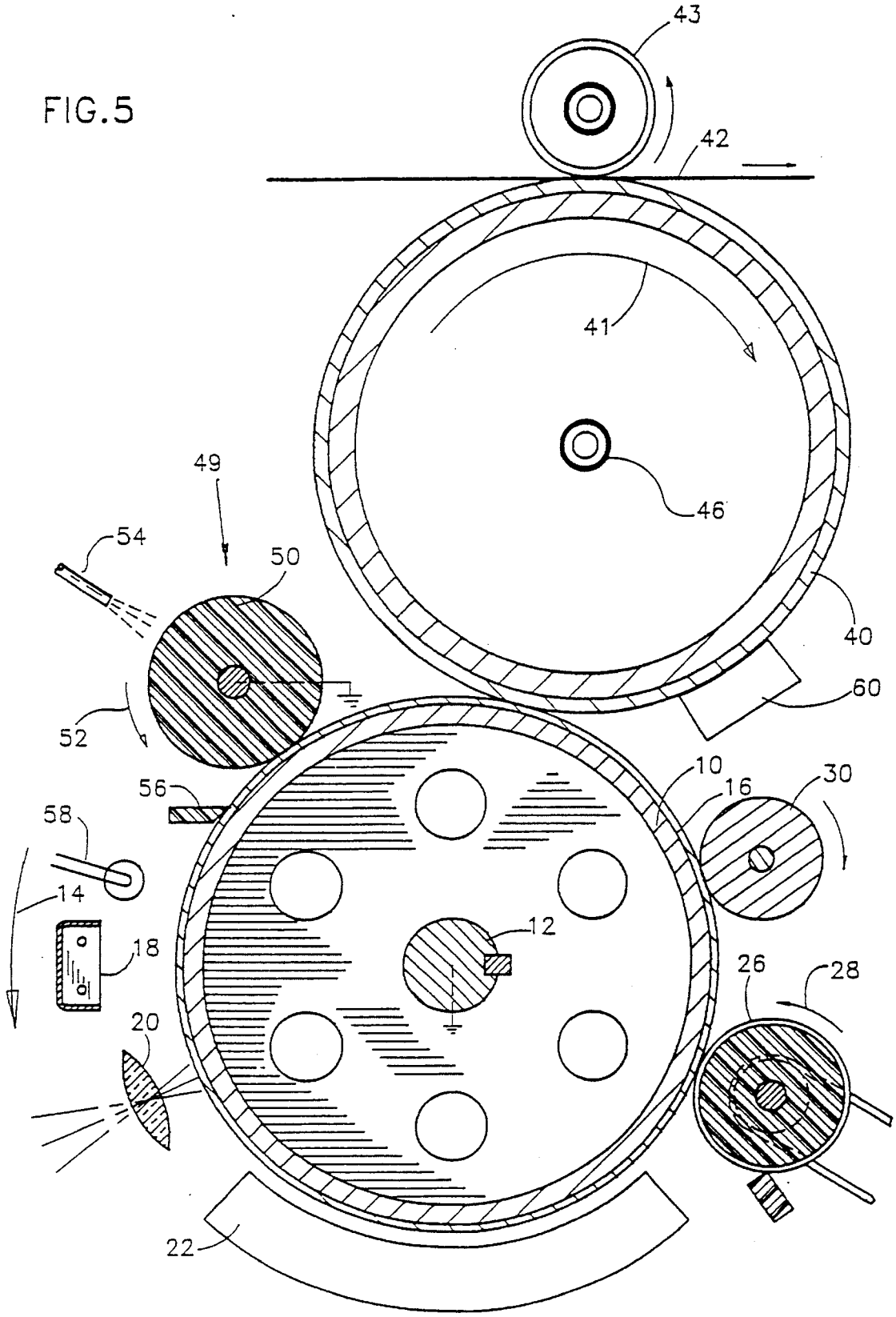
FIG. 5 is a simplified sectional illustration of electrophotographic apparatus constructed and operative in accordance with yet another preferred embodiment of the present invention.

Exemplary embodiments include the apparatus shown in FIG. 5. This apparatus is generally the same as the apparatus of FIG. 1, except that a cooling station 60 is operatively associated with intermediate transfer member 40 just before it returns to make contact with photoreceptor surface 16. Intermediate transfer member 40 is cooled at cooling station 60 to locally reduce the temperature of intermediate transfer member 40 before and during contact with the image on the photoreceptor. This local cooling allows the liquid toner image to be hotter at the point of final transfer from intermediate transfer member 40 to final substrate 42 than it is at first transfer from photoreceptor surface 16 to intermediate transfer member 40.

Cooling station 60 may comprise, for example, apparatus for providing a stream of cool air to the surface of the photoreceptor or a cooled roller in contact with the photoreceptor surface. Either or both cooling systems cool intermediate transfer member 40 to a temperature, higher than room temperature, but lower than the final transfer temperature.

In a multicolor system, if a roller cooler is used it is coated with a non-stick coating to avoid transfer of the image from intermediate transfer member 40 to the roller of cooling station 60.

Figure 6:
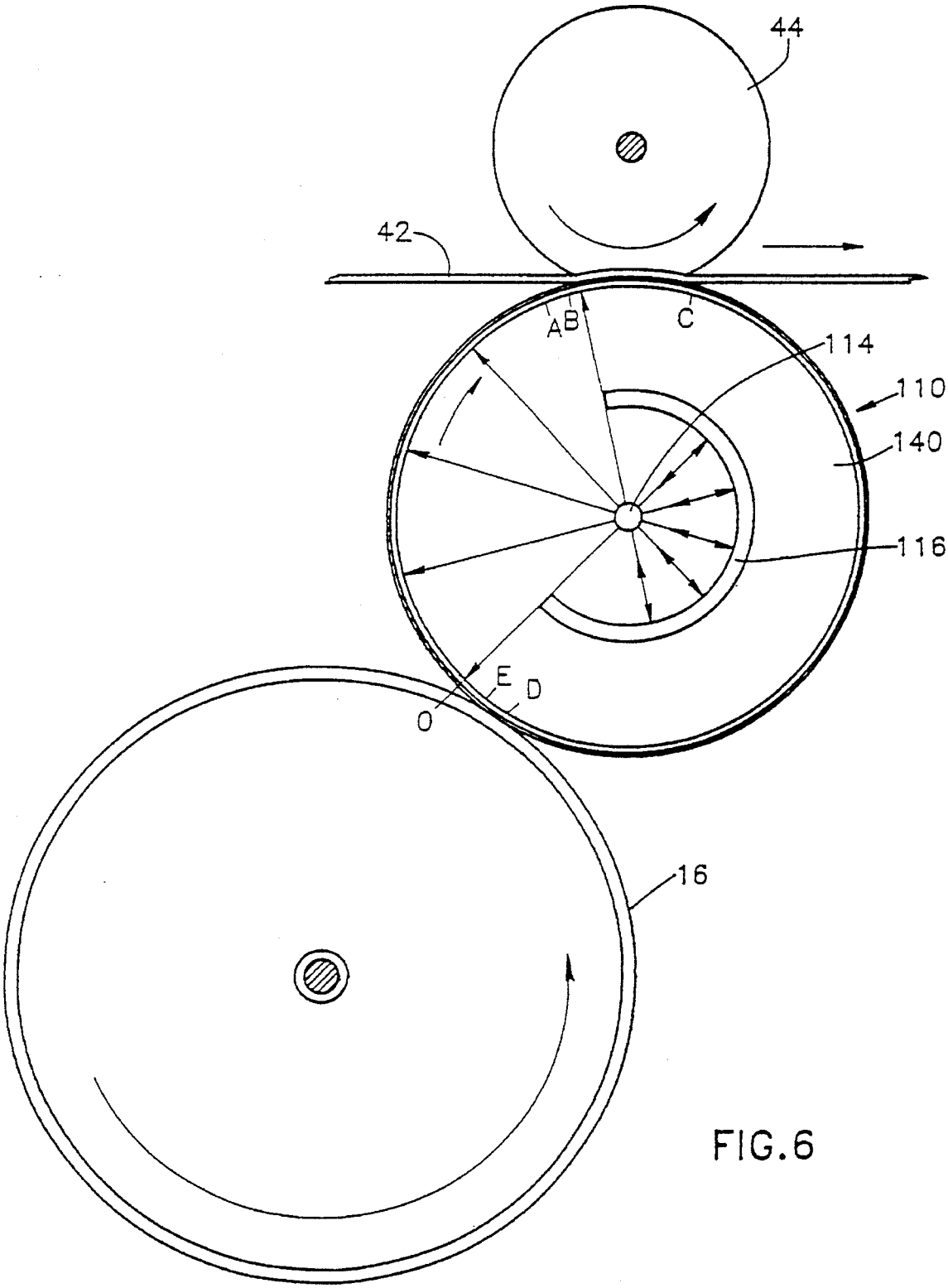
FIG. 6 is a simplified sectional illustration of electrophotographic apparatus constructed and operative in accordance with yet another preferred embodiment of the present invention.
Figure 7:
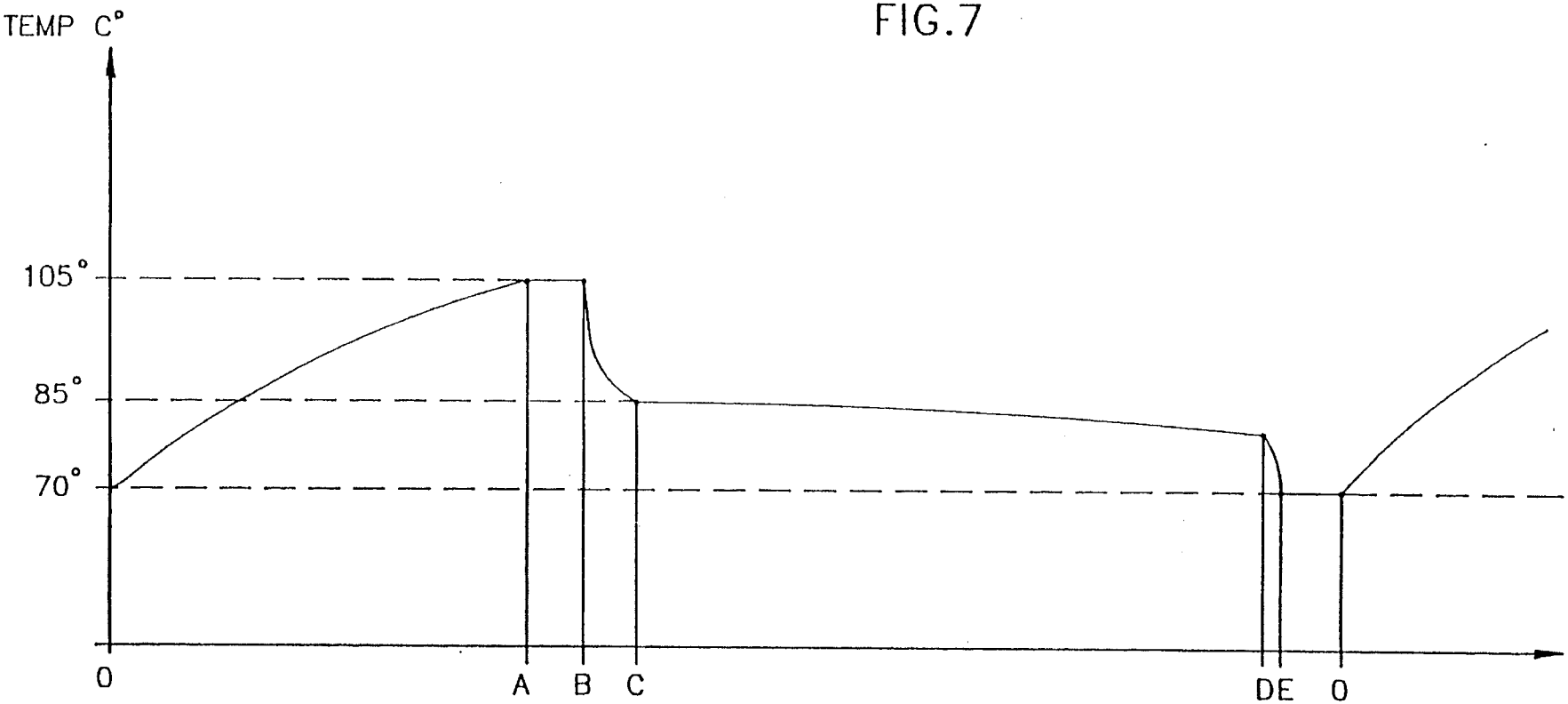
FIG. 7 is a graphical illustration of the temperature variation along a low thermal mass intermediate transfer member in an arrangement such as that illustrated in FIG. 6.

Another exemplary embodiment of this type is illustrated in FIG. 6, which is essentially the same as FIG. 8 of co-pending application U.S. Ser. No. 293,456, previously referenced. Here an intermediate transfer member 140 is of low heat capacity, and is heated only after first transfer is completed. As shown in FIG. 7, which is the same as FIG. 9 of the above referenced application, the temperature at the first transfer is above room temperature in order to improve first transfer, and the temperature at second transfer is even higher to assure complete or nearly complete second transfer. For a multi-color system the temperatures and heat capacities are selected so that the first transfer takes place at a temperature low enough to avoid back transfer.

In the above embodiments, intermediate transfer members 40 and 47 have been described as having heaters placed internal to the core to heat each of them to its required temperature. Other methods of heating intermediate transfer members known in the art can also be used in the practice of the invention.

EXAMPLES

Colored liquid developer is prepared in the following manner:

Preparation of Black Liquid Developer 10 parts by weight of Elvax 5720 (E. I. Du Pont) and 5 parts by weight of Isopar L are mixed at low speed in a jacketed double planetary mixer connected to an oil heating unit for one hour, the heating unit being set at 130 degrees C.

A mixture of 2.5 parts by weight of of Mogul L carbon black (Cabot) and 5 parts by weight of Isopar L are then added to the mix in the double planetary mixer and the resultant mixture is further mixed for one hour at high speed. 20 parts by weight of Isopar L preheated to 110 degrees C. are added to the mixer and mixing is continued at high speed for one hour. The heating unit is then disconnected and mixing is continued until the temperature of the mixture drops to 40 degrees C.

The resulting mixture is transferred to an S-1 attritor device equipped with 3/16 inch carbon steel media, diluted with Isopar L to a 16% solids ratio and ground without cooling until the temperature rises to about 60 degrees C. Cooling, which reduces the temperature to about 30 degrees is then commenced and grinding is continued for a total of 24 hours. The mixture is removed from the device and diluted with Isopar L to 1.5% by weight solids concentration. The particles in the resultant toner concentrate have an average diameter of 2.5 microns.

Charge director as known in the art, is added to give the final liquid developer. In a preferred embodiment of the invention the charge director of Example 1 of copending application U.S. Ser. No. 354,121 entitled HUMIDITY TOLERANT CHARGE DIRECTOR COMPOSITIONS and filed May 22, 1989, the contents of which are included herein by reference, is added to give the final liquid developer.

Preparation of Colored Developer 10 parts by weight of Elvax 5720 (E. I. Du Pont) and 5 parts by weight of Isopar L are mixed at low speed in a jacketed double planetary mixer connected to an oil heating unit for one hour, the heating unit being set at 130 degrees C.

Pre-heated Isopar L is then added to reduce the solids concentration to preferably 35% and mixing is continued at high speed for one hour. The heating unit is then disconnected and mixing is continued until the temperature of the mixture drops to 40 degrees C.

The mixture is then transferred to an S-1 attritor device equipped with 3/16 inch carbon steel media and pigment is added to the material in the attritor. The mixture is diluted with Isopar L to about a 12–16% solids ratio, depending on the viscosity of the material and is ground without cooling until the temperature rises to about 60 degrees C. Cooling, which reduces the temperature to about 30 degrees, is then commenced and grinding is continued for a total of 24 hours. The mixture is removed from the device and diluted with Isopar L to 1.5% by weight solids concentration. The particles in the resultant toner concentrate had an average diameter of 2.5 microns.

Charge director as known in the art, is added to give the final liquid developer. In a preferred embodiment of the invention the charge director of Example 1 of copending application U.S. Ser. No. 354,121 entitled HUMIDITY TOLERANT CHARGE DIRECTOR COMPOSITIONS and filed May 22, 1989, the contents of which are included herein by reference, is added to give the final liquid developer.

Appropriate colored pigments known in the art of liquid developer manufacture, for example the list given in U.S. Pat. No. 4,794,651 can be used. Other suitable pigments are Sico Fast Yellow D1350 (BASF), Lithol Rubin D4576 (BASF), Lyonol Blue FG7351 (TOYO) and Lyonol Yellow 7G1310 (TOYO). in amounts and combinations depending on the color and intensity required. Optionally, Aluminum Stearate can be added in small amounts. For pigments which are discolored by steel, other grinding media such as zirconia may be used.

These developers are used to form the individual color liquid toner images on photoreceptor surface 16 which comprise a relatively high concentration of toner particles in carrier liquid.

Photoreceptor surface 16 is preferably formed of selenium. Intermediate transfer member 40 is preferably formed of a cylindrical aluminum core coated with a 1 mm thick layer of very soft polyurethane having a hardness of 20–25 Shore A. This layer is covered by an offset printing blanket, preferably a KYNIO AIRTACK offset blanket, which is much harder than the polyurethane. A thin conducting layer of conducting acrylic covers this layer and is covered in turn by a 0.1 mm layer of polyurethane of shore A Hardness 20. This layer is overcoated by a thin layer of non-sticking, or syl-off type 291 or 294 silicone release coating which are release materials for the toner particles.

Liquid developer prepared in accordance with the method described above is used in the equipment of FIG. 1. Preferably the temperature of the intermediate transfer layer should be less than about 50 degrees C. For temperatures greater than about 50 degrees, there is a tendency for the previously transferred colors to back transfer to photoreceptor surface 16. Heating intermediate transfer member 40 improves image transfer to intermediate transfer member 40. Intermediate transfer member 40 is preferably heated to a temperature somewhat below that at which back transfer begins to occur.

It is believed that the improvement in first transfer when the intermediate transfer member is heated may be a consequence of partial solvation of carrier liquid by the pigmented toner particles in the image.

One characteristic of the liquid developers preferred in the practice of this invention is that the pigmented toner particles contained therein solvate the carrier liquid at elevated temperatures. It is believed that there is a partial solvation of the carrier liquid in the toner particles during first transfer to heated intermediate transfer member 40 which may cause the particles to partially coalesce and form a film during first transfer. Coalesced toner is believed to transfer better than uncoalesced toner particles.

Furthermore, when the toner material solvates some of the carrier liquid, the toner particles separate from the unsolvated carrier liquid. It is believed that this separated carrier liquid forms a film between the toner image and the photoreceptor which reduces the adhesion of the image to the photoreceptor, aiding complete transfer of the image to the intermediate transfer member.

It is to be understood that the heating of the image before and/or during final transfer insures the complete or nearly complete transfer of the image from the intermediate transfer member to the final substrate. Where this image heating comes solely by conduction from the paper, it has been found experimentally that the paper should be at a temperature of at least about 70 degrees C. Higher temperatures such as 80 or 90 degrees can also be used, but substantially lower temperatures do not tackify the image enough to assure complete transfer from intermediate transfer member 40 to paper 42.

The precise temperatures used for particular configurations and combinations are a function of the material properties of the toner particles and the carrier liquid as well as of the quality of the release layer on the intermediate transfer member. Back transfer occurs due to the tackiness of the image, but is also influenced by the relative adhesion of the image to the release layer on the intermediate transfer member and to the photoreceptor. It would be possible to increase the temperature of the intermediate transfer member if the release properties of the surface of the intermediate transfer member were poorer. This however would also result in poorer transfer to the final substrate.

In particular representative, operating examples the following temperatures are used. In a first example, which is used for the transfer of single color images, the intermediate transfer member is heated to a surface temperature of 100 degrees C. and the paper is not heated. Calculations show that the image is at a temperature of 52 to 63 degrees C. during first transfer. During the interval between first and second transfer the image temperature rises to the intermediate transfer member's temperature of 100 degrees C., and the image is cooled during second, final transfer to paper to a temperature of 73 to 78 degrees C.

In a second, representative, operating example for sequential transfer of multiple images to the intermediate transfer member, the intermediate transfer member is heated to 50 degrees C. and backing roller 43 is heated to 120 degrees C. The image temperature on first transfer is approximately 43 degrees C. and on second transfer it is 75 to 78 degrees C.

The temperatures shown in FIG. 7 are also representative of values suitable for single image transfer. For multi-image transfer to intermediate transfer member 140, the first transfer temperature must be low enough to assure that no back transfer takes place.

It will be understood that certain features and sub-combinations of the invention are useful, and may be employed without other features and sub-combinations. It is noted that various changes may be made in details within the scope of the claims without departing from the spirit of of the invention. It is therefor to be understood that the invention is not to be limited to the specific details shown and described.

We claim:

1. Imaging apparatus comprising:

an image bearing surface having a liquid toner image comprising carrier liquid and charged pigmented particles formed thereon;

an intermediate transfer member having a transfer surface coated with a release coating for said pigmented particles;

a transfer region which is formed intermediate said image bearing surface and said intermediate transfer member at which said image is electrostatically transferred to the transfer surface;

a heat source which heats said developed image during its transfer from said image bearing surface to said intermediate transfer member to a temperature effective in aiding said electrostatic transfer; and a second transfer region at which the image is transferred from the intermediate transfer member to a substrate.

2. Imaging apparatus according to claim 1 further comprising:

means for further heating said image on said intermediate transfer member during said transfer to said substrate.

3. Imaging apparatus according to claim 1 further comprising:

means for further heating said image on said intermediate transfer member prior to said transfer to said substrate.

4. Apparatus according to claim 1 wherein said image bearing surface has a latent electrostatic image formed thereon and further comprising:

a developer which transfers toner particles to portions of the latent image thereby to form the liquid toner image thereon.

5. A method of transferring a first liquid toner image from a first surface having a first temperature to a second surface coated with a non-stick surface for said toner and having a second liquid toner image thereon, comprising the steps of:

electrostatically transferring said liquid toner image to said second surface while heating said second surface to a second temperature at transfer operative to aid said electrostatic transfer, which second temperature is higher than said first temperature; and transferring said first and second images to a substrate from said second surface.

6. A method according to claim 5 wherein said second temperature is lower than a temperature at which said second liquid toner image would transfer to said first surface from said second surface.

7. A method according to claim 5 wherein said transferring is by electrophoresis.

8. Imaging apparatus for printing multicolor images from first and second latent images formed on a latent image bearing surface comprising:

a first developer which utilizes a liquid developer comprising carrier liquid and charged pigmented toner particles of a first color and transfers toner particles to portions of the first latent image to form a first developed image on the latent image bearing surface;

a second developer which utilizes a liquid developer comprising carrier liquid and charged pigmented toner particles of a second color and transfers toner particles to portions of the second latent image to form a second developed image on the latent image bearing surface;

an intermediate transfer member coated with a non-stick coating for said pigmented particles forming a transfer surface thereon;

a transfer region which is formed intermediate said image bearing surface and said intermediate transfer member at which said first and second developed images are sequentially electrostatically transferred to the transfer surface in mutual alignment;

a heat source which heats said developed images before completion of their respective transfers from said latent image bearing surface to said intermediate transfer member to a temperature effective in aiding said electrostatic transfer; and a second transfer region at which the images are transferred from the transfer surface of the intermediate transfer member to a substrate.

9. Apparatus according to claim 8 wherein said substrate is the surface of a second transfer member adapted to receive images from said intermediate transfer member prior to transfer of said images to a final substrate.

10. Apparatus according to claim 8 further comprising:

heating means for further heating of said developed first transferred image such that it is at a higher temperature during its transfer to said substrate than during its transfer to said intermediate transfer member.

11. Apparatus according to claim 8 further comprising:

heating means for further heating of said developed first transferred image during transfer to said substrate.

12. A method for forming an image on a final substrate comprising:

forming a first liquid toner image on a surface using a liquid developer, comprising carrier liquid and charged toner particles;

transferring said first liquid toner image to an intermediate transfer member coated with a non-stick coating for said charged toner particles, said first liquid toner image being at a higher temperature during said transfer than during its formation;

forming a second liquid toner image using a liquid developer comprising carrier liquid and charged particles;

transferring said second liquid toner image to said intermediate transfer member at least partially superimposed on said first liquid toner image to form multiple images, said second liquid toner image being at a higher temperature during its transfer than during its formation; and transferring said first and second liquid toner images to a final substrate.

13. A method according to claim 12 further comprising:

transferring said multiple images to a substrate, said multiple images being at a higher temperature during said multiple image transfer than during the transfer of said first and second liquid toner image.

14. A method according to claim 12 wherein forming a first liquid toner image includes developing a latent electrostatic image on said image bearing surface.

15. A method according to claim 14 wherein forming a second liquid toner image includes developing a latent electrostatic image on said image bearing surface.

16. A method for printing an image comprising:

forming a liquid toner image on an image bearing surface using a liquid toner, comprising carrier liquid and charged pigmented particles;

electrostatically transferring said liquid toner image to an intermediate transfer member from said image bearing surface for subsequent transfer to a final substrate;

heating said developed image during its transfer from said image bearing surface to said intermediate transfer member to a temperature effective in aiding said electrostatic transfer; and transferring the image to a final substrate from said intermediate transfer member.

17. A method according to claim 16 wherein forming a liquid toner image includes the step of developing a latent electrostatic image on said image bearing surface.

18. Imaging apparatus comprising:

an image bearing surface having a liquid toner image comprising carrier liquid and charged pigmented particles formed thereon;

an intermediate transfer member having a transfer surface coated with a release coating;

a transfer region which is formed intermediate said image bearing surface and said intermediate transfer member at which said image is electrostatically transferred to the transfer surface;

a heat source which heats said liquid toner image during its transfer from said image bearing surface to said intermediate transfer member to a temperature effective in aiding said electrostatic transfer; and a second transfer region at which the image is transferred from the intermediate transfer member to a substrate.

19. An imaging apparatus for printing multicolor images from first and second-latent images formed an a latent image bearing surface comprising:

a first developer which utilizes a liquid developer comprising carrier liquid and charged pigmented toner particles of a first color and transfers toner particles to portions of the first latent image to form a first developed image;

a second developer which utilizes a liquid developer comprising carrier liquid and charged pigmented toner particles of a second color and transfers toner particles to portions of the second latent image to form a second developed image;

an intermediate transfer member coated with a non-stick coating for said pigmented particles forming a transfer surface thereon;

a transfer region which is formed intermediate said image bearing surface and said transfer surface on said intermediate transfer member at which said first and second developed images are electrostatically transferred in mutual alignment from the image bearing surface to the transfer surface;

a heat source which heats said developed images before completion of their respective transfers from said latent image bearing surface to said intermediate transfer member to a temperature effective in aiding said electrostatic transfer; and a second transfer region at which the images are transferred from the intermediate transfer member to a substrate.

20. A method fur forming an image on a final substrate comprising:

forming a first liquid toner image on a surface using a liquid developer comprising carrier liquid and charged toner particles;

transferring said first liquid toner image to an intermediate transfer member coated with a release coating;

forming a second liquid toner image on a surface using a liquid developer comprising carrier liquid and charged toner particles;

transferring said second liquid toner image to the intermediate transfer member at least partially superimposed on the first liquid toner image, said second liquid toner image being at a higher temperature during its transfer than during its formation; and transferring the at least partially superimposed liquid toner images to a final substrate.

21. A method for forming an image on a final substrate comprising:

forming a first liquid toner image on a surface using a liquid developer comprising carrier liquid and charged toner particles;

transferring said first liquid toner image to an intermediate transfer member coated with a release coating for the toner particles;

forming a second liquid toner image on a surface using a liquid developer comprising carrier liquid and charged toner particles;

transferring said second liquid toner image to the intermediate transfer member at least partially superimposed on the first liquid toner image, said second liquid toner image being at a higher temperature during its transfer than during its formation; and transferring the at least partially superimposed liquid toner images to a final substrate.

22. A method for forming an image on a final substrate comprising:

forming a first liquid toner image on a surface using a liquid developer comprising carrier liquid and charged toner particles;

electrostatically transferring said first liquid toner image to an intermediate transfer member coated with a release coating;

forming a second liquid toner image on a surface using a liquid developer comprising carrier liquid and charged toner particles;

transferring said second liquid toner image to the intermediate transfer member at least partially superimposed on the first liquid toner image, said second liquid toner image being at a higher temperature during its transfer than during its formation; and transferring the at least partially superimposed liquid toner images to a final substrate.

23. A method for forming an image on a final substrate comprising:

forming a first liquid toner image on a surface using a liquid developer comprising carrier liquid and charged toner particles;

electrostatically transferring said first liquid toner image to an intermediate transfer member coated with a release coating for the toner particles;

forming a second liquid toner image on a surface using a liquid developer comprising carrier liquid and charged toner particles;

transferring said second liquid toner image to the intermediate transfer member at least partially superimposed on the first liquid toner image, said second liquid toner image being at a higher temperature during its transfer than during its formation; and transferring the at least partially superimposed liquid toner images to a final substrate.

24. A method for printing an image comprising:

forming a liquid toner image on an image bearing surface using a liquid toner, said liquid toner image comprising carrier liquid and charged toner particles;

electrostatically transferring the liquid toner image from the image bearing surface to an intermediate transfer member coated with a release coating;

heating the developed image during its transfer from the image bearing surface to the intermediate transfer member to a temperature effective in aiding the electrostatic transfer; and transferring the image from the intermediate transfer member to a substrate.

25. A method for printing an image comprising:

forming a liquid toner image on an image bearing surface using a liquid toner, said liquid toner image comprising carrier liquid and charged toner particles;

electrostatically transferring the liquid toner image from the image bearing surface to an intermediate transfer member coated with a release coating for the toner particles;

heating the developed image during its transfer from the image bearing surface to the intermediate transfer member to a temperature effective in aiding the electrostatic transfer; and transferring the image from the intermediate transfer member to a substrate.

* * * * *

UNITED STATES PATENT AND TRADEMARK OFFICE

CERTIFICATE OF CORRECTION

PATENT NO. : 5,572,274

DATED : November 5, 1996

INVENTOR(S) : I. Lior, et. al.

It is certified that error appears in the above-indentified patent and that said Letters Patent is hereby corrected as shown below:

Title page, item [57], Abstract, line 3, change "tuner" to --toner--.

Column 16, line 15 (claim 20, line 1), change "fur" to --for--.

Signed and Sealed this

Sixth Day of May, 1997

*Attest:*

*Attesting Officer*

BRUCE LEHMAN

*Commissioner of Patents and Trademarks*